US010967538B2

(12) United States Patent
Pattis et al.

(10) Patent No.: US 10,967,538 B2
(45) Date of Patent: Apr. 6, 2021

(54) APPARATUS AND METHOD FOR CONTINUOUS PRODUCTION OF MATERIALS

(71) Applicant: DIEFFENBACHER GMBH MASCHINEN- UND ANLAGENBAU, Eppingen (DE)

(72) Inventors: Reto Pattis, Eppingen (DE); Helmut Bauser, Eppingen (DE)

(73) Assignee: DIEFFENBACHER GMBH MASCHINEN-UND ANLAGENBAU, Eppingen (DE)

( * ) Notice: Subject to any disclaimer, the term of this patent is extended or adjusted under 35 U.S.C. 154(b) by 352 days.

(21) Appl. No.: 15/573,075

(22) PCT Filed: May 11, 2016

(86) PCT No.: PCT/EP2016/060574
§ 371 (c)(1),
(2) Date: Nov. 9, 2017

(87) PCT Pub. No.: WO2016/180886
PCT Pub. Date: Nov. 17, 2016

(65) Prior Publication Data

US 2018/0141234 A1 May 24, 2018

(30) Foreign Application Priority Data

May 11, 2015 (DE) ..... 10 2015 107 374.9

(51) Int. Cl.

| | |
|---|---|
| ***B27N 3/18*** | (2006.01) |
| ***H05B 6/78*** | (2006.01) |
| *B27N 1/00* | (2006.01) |
| *B27N 3/24* | (2006.01) |

(52) U.S. Cl.
CPC ..... *B27N 3/18* (2013.01); *H05B 6/78* (2013.01); *B27N 1/00* (2013.01); *B27N 3/24* (2013.01)

(58) Field of Classification Search
CPC .... B27N 3/18; B27N 3/24; B27N 1/00; B30B 5/06; H05B 6/78
See application file for complete search history.

(56) References Cited

U.S. PATENT DOCUMENTS 5,286,939 A * 2/1994 Martin ..... H05B 6/804 219/486
6,133,500 A 10/2000 Emery
(Continued)

FOREIGN PATENT DOCUMENTS

CN 202448195 * 11/2011
CN 202448195 U 9/2012
(Continued)

OTHER PUBLICATIONS

International Search Report with English Translation and Written Opinion issued in corresponding application No. PCT/EP2016/060574 dated Aug. 1, 2016.
(Continued)

*Primary Examiner* — Vishal Pancholi
*Assistant Examiner* — Bob Zadeh
(74) *Attorney, Agent, or Firm* — Foley & Lardner LLP

(57) ABSTRACT

An apparatus and method for the continuous production of materials, preferably for producing material boards made of essentially non-metallic material, comprising
a continuous furnace (1) for continuously heating material (3) on an endlessly circulating conveyor belt (10) and
a press (2) provided downstream in the production direction (15),
wherein the continuous furnace (1) comprises a plurality of magnetrons (4) for generating electromagnetic waves and
(Continued)

Figure 1:
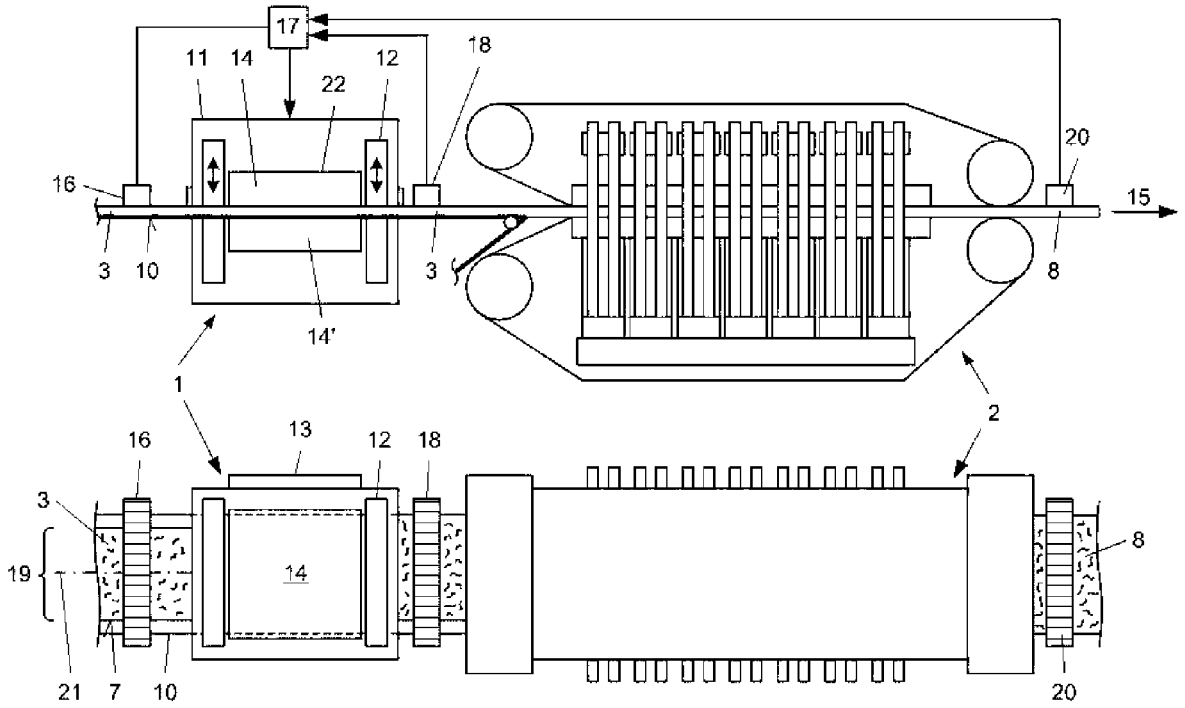

hollow conductors (5) with outlet openings (6) for feeding the waves into a radiation chamber (14). The invention is intended to solve the problem of reacting to various operating modes for the continuous furnace and, in particular, to heat up the material used in the best possible manner for later pressing. The invention is characterized in that a control or regulating apparatus (17) is arranged for controlling individual or grouped magnetrons (4) in order to provide them with different powers (L) for producing a differentiated power profile (9), preferably in and/or transversely to the production direction (15). (1491)

15 Claims, 2 Drawing Sheets

(56) References Cited

U.S. PATENT DOCUMENTS

2007/0194016 A1* 8/2007 Dalton ..... B01J 19/02 219/759
2014/0103031 A1* 4/2014 Peelamedu ..... H05B 6/6482 219/700
2018/0141234 A1* 5/2018 Pattis ..... H05B 6/78

FOREIGN PATENT DOCUMENTS

| | | | |
|---|---|---|---|
| DE | 40 32 496 | A1 | 4/1991 |
| DE | 10157601 | A1 | 6/2003 |
| DE | 10 2013 105 928 | A1 | 12/2014 |
| EP | 2 247 418 | B1 | 5/2013 |
| EP | 2 767 389 | A1 | 8/2014 |
| WO | WO-2005/046950 | A1 | 5/2005 |

OTHER PUBLICATIONS

International Search Report with English Translation and Written Opinion issued in corresponding application No. PCT/EP2016/060580 dated Aug. 1, 2016.
Office Action received in European Patent Application No. 16 723 711.4 dated Jul. 26, 2019.
Non-Final Office Action in U.S. Appl. No. 15/573,097 dated Apr. 16, 2020.

* cited by examiner

APPARATUS AND METHOD FOR CONTINUOUS PRODUCTION OF MATERIALS

CROSS REFERENCE TO RELATED APPLICATIONS

The present application is a U.S. National Stage of International Application No. PCT/EP2016/060574 filed on May 11, 2016, which claims priority from DE 10 2015 107 374.9, filed on May 11, 2015, the entire disclosures of which are incorporated herein by reference.

The invention relates to an apparatus for the continuous production of materials, preferably for producing material boards made from substantially non-metallic material.

The invention further relates to a method for the continuous production of materials, preferably for producing material boards made of essentially non-metallic material.

The pressing of comminuted or pulped biomass, wood or wood-like materials into material boards is known. Examples of such material boards are MDF boards of medium-density fibers, oriented chip boards (OSB), veneer boards (LVL, OSL), fiber insulation boards/mats or the like. In order to increase the production capacity of continuously operating presses, it is also known to heat the material, which is spread to form a nonwoven or strand, with appropriate apparatuses before the entry into the press. Due to the higher heat at the beginning of the pressing, the press takes less time to thoroughly heat the nonwoven. Accordingly, the press can be designed to be shorter or operated faster. Hot-air or steam preheaters or the use of high-frequency radiation (HF, MW) for preheating in continuous microwave furnaces, which are referred to below as continuous furnaces, have proven to be successful. The physical principle is based on the conversion of electromagnetic energy into heat energy during the absorption of the microwaves by the material to be heated.

WO 2005 046 950 A1 discloses a particle board or chipboard and a method for its production. This particle board consists of at least three layers, wherein the outer layers are made of fine material, while the middle layer consists of coarser material. In order to save a maximum of material, it is envisaged to principally produce the board with a low proportion of material, wherein only a higher proportion of material is to be scattered at the points of the board which are used later for the incorporation of fittings or fastening elements in order to make connections with other parts. For this purpose, it is proposed to continuously spread a higher proportion of material in the longitudinal direction or in the direction of production of the pressed material mat onto the forming belt or onto the already existing bottom cover layer in order to obtain mutually spaced tracks in the direction of production with a higher material input of the pressed material mat, which have a higher density after production of a board which is evenly thick in length and width. In addition, by means of a nozzle which can be moved transversely to the production direction, material can also be applied at certain points, preferably in the transverse direction. This serves to obtain, from a split board strand, chipboards which have a higher density for the assembly of fittings or connecting means, but which use less material and density in the surface.

During the production of the nonwoven, a surface weight profile is produced over the width or length of the nonwoven, which naturally also can generate different nonwoven heights. In this case, the density (at different heights) does not necessarily have to be different. If, however, the nonwoven is pressed uniformly over the width or passes through a press nip which is uniform over the width, it will have different densities due to the different surface weights.

In addition to the problems in the manufacture of a nonwoven, difficulties have arisen in the pressing of a nonwoven with different surface weights. In particular, it is problematic that a continuously operating press with circumferential steel bands tends to the steel strip course since different pressures act over the length and width on the steel strips and possibly on the rolling support. On the other hand, problems arise in the heat transfer from the hot steel strips into the nonwoven, since the differently dense areas in the uniform press nip of the nonwoven also behave differently with regard to the heat transfer. It has been shown that, despite the average lower density, a pressed material mat with a differentiated density profile over the length and/or width requires just as long for curing as for a pressed material mat without density reductions.

Even if, in the case of a cycle press, the problem of the steel strip course does not occur in the first place, the disadvantage also arises in that the pressing must last until the material board has completely set in all areas.

A method and an apparatus for heating a nonwoven before a press are known from EP 2 247 418 B1. It is proposed in this disclosure that 20 to 300 microwave generators with magnetrons with a power of 3 to 50 kW and with a frequency range of 2400 to 2500 MHz are to be arranged in a continuous furnace for each press surface. The large number of generators and the frequency necessary for the apparatus and the method advantageously result in a small size of the radiation openings in the heating chamber at the microwave frequency used. The disclosure teaches the person skilled in the art only that a plurality of microwave generators with an equal power are to be used and correspondingly are also to be controlled uniformly.

The apparatus and the method described in this patent have proved their worth in industrial applications, but can be further improved for industrial applications.

It is also generally known to homogenise the microwaves within a heating chamber, hereinafter referred to as a radiation chamber, by means of suitable apparatuses. Such apparatuses are, for example, metallic rotary vanes. Alternatively, the material to be heated can be placed on rotating turntables. Such a homogenisation of the radiation within the radiation chamber can also be useful in a continuous furnace with a plurality of microwave generators, referred to hereafter as magnetrons, even if the material to be heated is guided continuously through the radiation chamber by means of a conveyor belt.

Details with regard to safety-relevant embodiments or other embodiments of the gate technology of the continuous furnace for the introduction and removal of the material is described in the further state of the art and is not the subject of the present invention.

In the above-mentioned prior art, a plurality of magnetrons is used to produce the necessary heating of the material. The effort appears to be justified, since the material can be heated through without introducing moisture into the material, as would be the case, for example, with the use of steam. The higher energy input and the associated costs are compensated by the lower specific energy expenditure per unit of the final product.

It is a disadvantage of the above-mentioned prior art that, in the event of a failure of one or more magnetrons for example, the operation must be interrupted, since the material is heated unevenly.

The above apparatus also has the disadvantage that no width adjustment is provided since it is assumed that besides the loss of the radiation in the absorbers, the radiation is predominantly and substantially uniformly absorbed in the material.

Furthermore, the above apparatus has the disadvantage that the different material widths and heights can be easily moved into and out of the continuous furnace by means of the proposed width and height adjustment of the gates, but the power loss of the continuous furnace is disproportionately high in the case of narrow widths and simultaneously large volume of the material.

It is the object of the present invention to further develop the apparatus and the method so that the disadvantages described above can be avoided. In particular, it should be possible to optimally heat differently high and/or wide strands of materials with the continuous furnace and to avoid unnecessary loss of power. In an extension of the object, the failure probability of the apparatus is to be reduced by establishing an emergency running program in the event of failure of one or a few magnetrons.

The invention is based on an apparatus for the continuous production of materials, preferably for the production of material boards made of essentially non-metallic material, which at least comprises a continuous furnace for continuously heating material on an endlessly circulating conveyor belt and further comprises a press arranged downstream in the production direction, wherein the continuous furnace has a plurality of magnetrons for generating electromagnetic waves and hollow conductors with outlet openings for feeding the waves into a radiation chamber.

According to the invention, the object for the apparatus is achieved in that a control or regulating apparatus is arranged for controlling individual or grouped magnetrons in order to operate them with different powers for producing a differentiated power profile, preferably in and/or transversely to the production direction.

The invention has recognised that, depending on the application and the embodiment of the apparatus, it may be appropriate to arrange only one track or row of outlet openings angularly, longitudinally and/or transversely to the production direction. The material is preferably present in the form of an endless strand on the conveyor belt and has two faces, wherein one of these faces is supported on the conveyor belt and has at least two edges in the production direction.

The person skilled in the art has hitherto assumed, as also described in the prior art, that the electromagnetic radiation is distributed more or less uniformly in the radiation chamber after exiting the hollow conductor. However, a targeted irradiation of the (fanned out) primary waves (after exiting without reflection) into the material leads to a relatively concentrated local heating. Unabsorbed radiation is finally deflected or reflected and absorbed as a secondary wave either somewhere in the material or trapped by the absorbers.

It is preferably provided that the outlet openings of the hollow conductors are arranged in at least one essentially parallel plane to the conveyor belt. There may be several planes with different distances to the material.

Preferably, in addition to round hollow conductors, rectangular and/or oval hollow conductors are arranged.

In addition to the simplest variant, arrangement of a series of outlet openings above the material in any arrangement, i.e. transversely, longitudinally, diagonally, for a plurality of magnetrons the corresponding outlet openings can be arranged longitudinally and transversely to the production direction in rows $R_n$, $R_{n+1}$ and tracks $S_n$, $S_{n+1}$.

In the case of an offset arrangement of the outlet openings in the production direction, the surfaces of the outlet openings of the adjacent tracks $S_n$, $S_{n+1}$ can be arranged spaced, adjoining or overlapping in a longitudinal manner to the production direction. For a uniform or targeted heating, it is advisable to arrange as many tracks as possible (parallel to the production direction). In this sense, it may be useful for successive rows to have offset exit openings, so that two or more rows could each define a separate track group.

The control or regulating apparatus is preferably designed to retrieve suitably predefined power profiles based on the material and/or the product to be produced and to adjust it in the continuous furnace. The industrial production plants in question are usually suitable for producing a variety of different products and also different sizes of a single product. In this respect, it is advantageous if the operator or an automated recognition of the incoming material can provide a retrievable basic setting of the magnetron via a control or regulating apparatus.

At least one measuring apparatus for testing the material and/or the product can be arranged in operative connection with the control or regulating apparatus for controlling or regulating the power of the magnetron or of the power profile. In this case, it is particularly advantageous if the measuring apparatus is adjustable in sections over the width, particularly preferably in the same tracks as the continuous furnace has magnetrons/outlet openings. In addition or alternatively, further preceding apparatuses of the production facility or the control station of the system can be operatively connected to the control or regulating apparatus for controlling or regulating the power of the magnetrons or the power profile.

Preferably, the measuring apparatus is raised before and after the continuous furnace to the surface weight, the density, the moisture, the temperature, the volume and/or the position of the material on the conveyor belt. The same or similar parameters are measured by the measuring apparatus after the press. Each existing measuring apparatus thereby transmits the measured values to the control or regulating apparatus for the automated matching of the actual values with the predetermined setpoints. In particular, the temperature difference $\Delta T$ before and after the continuous furnace is of importance, which in particular also differentiates over the width at different heights and/or surface weights.

As is known from the prior art, the material can change its size and, in particular, its position on the conveyor belt, wherein hitherto only the gate technology has been controlled at the inlet and outlet of the continuous furnace. With the apparatus according to the invention, it is now also possible, in the case of a material which is arranged relatively narrowly on the conveyor belt, to have an influence on the available magnetrons by operating only the magnetrons above the material, for example. The magnetrons, under whose outlet openings no material is transported, are switched off. By means of the course of the material on the conveyor belt or a course of the conveyor belt itself, tracks of the magnetrons that are situated on the outside are automatically switched off or switched on.

In the case of an existing power profile, however, it will also be necessary to shift it according to the position of the material by the corresponding number of tracks.

Magnetrons with a power from 0.5 to 20 kW, preferably up to 6 kW, are particularly preferably used.

A passive and/or active distribution means for the electromagnetic waves can be arranged in the radiation chamber.

Such a distribution means is known in the art as a wobbler, and is usually a sheet of geometrical shape arranged movable (rotatable) in an active version. With the arrangement of such a distribution means, it is particularly preferred that means for activating or deactivating the distribution means are arranged in the continuous furnace. These means may, for example, be suitable for covering or removing the distribution means from the radiation chamber.

Particularly preferably, the drive, or its control, of the conveyor belt or a measuring apparatus for the speed of the forming belt, can be arranged in operative connection with the control and regulating apparatus. This is to be used to carry out, via the values, a calibration of the power cycle and/or the utilisation cycle of the magnetrons against the feed of the material. In this case, it should be avoided that local overheating or insufficiently heated areas in the material are produced by the clocked operation of the magnetron.

In order to adapt the continuous furnace to different widths and/or varying position of the material on the conveyor belt, the magnetrons of the tracks arranged outside the material can be arranged correspondingly to be reducible or disconnectable in their capacity.

It is the solution of the set object for a method that the magnetrons are controlled individually or in a grouped manner with different powers in order to operate them with a differentiated power profile, preferably in and/or transversely to the production direction.

Preferably, the magnetrons are controlled by a control or regulating apparatus. This is particularly suitable for retrieving and setting power profiles predetermined by the material and/or the product to be produced.

Preferably, the material and/or the product can be checked by means of at least one measuring apparatus, preferably sectionwise longitudinally and/or transversely, and the corresponding measured values can be dispatched to the control or regulating apparatus for controlling or regulating the magnetrons or the power profile.

When setting a power profile or differentiated performance of different magnetrons, a passive and/or active distribution means for the electromagnetic waves in the radiation chamber can be deactivated during the heating of the material. This deactivation can, for example, be carried out by covering or by moving out of the radiation chamber.

It may be advantageous in the subsequent pressing of the material if a power profile of the magnetron is adjusted transversely to the direction of production in such a way that a higher temperature of the material is set starting from the edges up to the longitudinal centre line of the material. This is particularly desirable when, due to the material, the binder, the moisture in or on the material, a flow develops during the pressing which is directed towards the narrow side of the material. In this case, the material is additionally heated by the heated fluid flow in the vicinity of the edges. It can now lead to the edges of the material being overheated in the case of a uniformly heated material. To avoid this, the edges are heated less strongly.

In the case of a material with a different surface weight profile over the width, it can be advantageous, alternatively or in combination, if a power profile of the magnetron is adjusted transversely to the production direction, which takes account of the different surface weight profile. The regions of different surface weights are thereby subjected to different powers of the electromagnetic waves, or the magnetrons of the outlet openings located above are operated with different powers.

Alternatively or in combination, it can be provided that, when using wood or wood-like material with a different surface weight profile over the width, the magnetrons with outlet openings substantially above the higher surface weight are operated at a higher power than the magnetrons with outlet openings above the regions of a lower surface weight.

Alternatively or in combination, in the case of an arrangement of several rows of magnetrons in the production direction and in the case of a failure of a magnetron and in the absence of its energy input into the material, one or more other magnetrons of the associated and/or adjacent tracks can compensate for the failure by increasing their power. If the magnetrons or the continuous furnace are/is already operated with the maximum possible power, then the failure is compensated by switching off the entire row to the extent that the speed of the conveyor belt is correspondingly reduced. This does not lead to undesired results in the pre-heating, such as, for example, hot nests or locally too low heating.

It is also advantageous if, at different widths of the material and/or a varying position of the material on the conveyor belt, at least one track of the magnetrons arranged at the edge, i.e. at the outside, is correspondingly reduced or deactivated in its power.

Alternatively or in combination, further magnetrons, preferably entire rows (Rx) of magnetrons which are not used in regular operation and can be switched on in the event of a magnetron failure, can be arranged to increase the redundancy of the apparatus.

Alternatively or in combination, the control or regulating apparatus is capable of detecting whether the function is ensured by means of monitoring or detection at the magnetrons or their power consumption, and, if not, will automatically switch on further magnetrons with the necessary power.

The control or regulating apparatus is capable of applying higher power to local surface weight increases, in particular surface weight increases occurring transversely to the production direction, in the material via a path/time tracking in the radiation chamber, and of controlling the magnetrons for this purpose in a corresponding temporal and geometrical arrangement.

The apparatus is suitable for carrying out the method but can also be operated independently.

Figure 2:
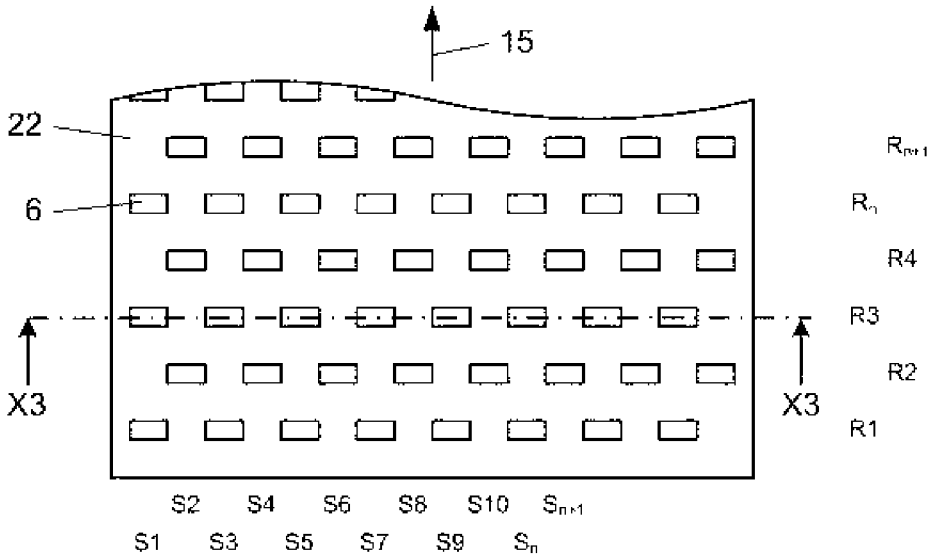
Figure 3:
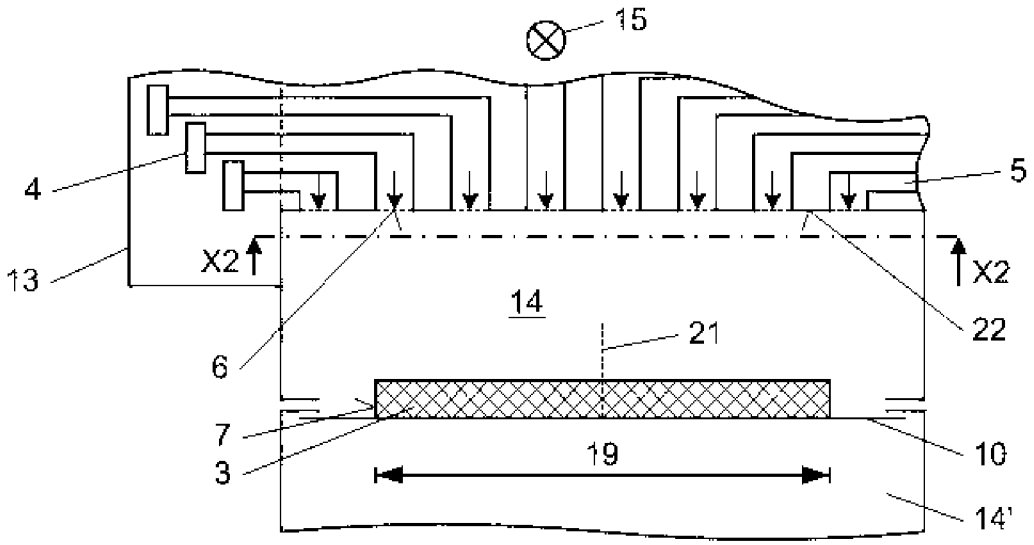
Figure 4:
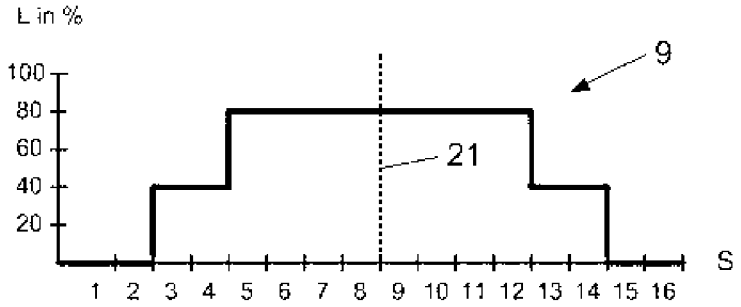

With reference to the accompanying drawings, details and exemplary embodiments of the invention are explained in more detail, wherein the drawings show as follows:

FIG. 1 shows a schematic side view (top) and an associated schematic view (bottom) of an apparatus with a strand of material, which is guided in the production direction through a continuous furnace and a double-belt press, FIG. 2 shows a top view of the cover of the radiation chamber of the continuous furnace with an exemplary arrangement of the hollow conductor, FIG. 3 shows a section X3 in the production direction according to FIG. 2 through the radiation chamber, and FIG. 4 shows an exemplary representation of a power profile for producing a material board of lignocellulosic material and corresponding edge cut-off of the outside rows of magnetrons.

FIG. 1 shows at the top a schematic side view and at the bottom a corresponding schematic top view of an apparatus with a steel strip running in the production direction 15 through a continuous furnace 1 and a continuously operating press 2 with two endlessly circulating steel strips which pull the strand-like material 3 through the press 2. The material 3 is transported in this case on the conveyor belt 10 from the left through the continuous furnace 1, where it is heated in a radiation chamber 14, transferred to the press 2 and is pressed and cured there into a product 8.

Depending on the embodiment of the apparatus, a radiation chamber 14 can be arranged for a higher efficiency not only from an upper or lower surface side, but the material 3 can also be subjected with microwaves from the other surface side in a radiation chamber 14'. This may especially be necessary if the penetration depth of the microwaves from one side does not sufficiently heat through the material 3 or if the power for heating is to be increased. In addition to a shielding housing 11, the continuous furnace 1 also has absorbers 12 around the radiation chamber 14, which absorb excess microwaves on the inlet and outlet sides and, in addition to the gates only indicated there, prevent the emergence of microwaves from the continuous furnace 1. The gates and/or the absorbers 12 are designed to be height-adjustable and/or width-adjustable for adaptation to different heights and widths of the continuous material 3.

The apparatus according to the invention has a control or regulating apparatus 17, which is capable of controlling the plurality of magnetrons 4 for the purpose of producing microwaves with respect to their power. In particular, it is provided that the control or regulating apparatus 17 can control individual or grouped magnetrons 4. The control or regulating apparatus 17 is preferably operatively connected to a storage apparatus and/or a computing unit which already contains recipes or predetermined frame data for setting the continuous furnace 1 or the magnetron 4. In particular, calculation bases can be stored here, on the basis of which the control or regulating apparatus 17, in conjunction with inputs from the operating personnel, realises proposals or settings with respect to the type of the material 3 and/or the product 8 to be produced, with which the continuous furnace 1 can operate in conjunction with the downstream press 2 in an optimum range which is harmless for the material 3.

In an alternative or combined embodiment, measuring apparatuses 16 can be arranged in the production direction 15 upstream of the continuous furnace 1, and measuring apparatuses 18 downstream of the continuous furnace 1 and upstream of the press 2 for the material 3. Alternatively or in combination, it can be provided to arrange a measuring apparatus 20 for the product 8 at the outlet of the press 2. It is common to all of these measuring apparatuses, or possibly further measuring apparatuses, that they can be in operative connection with the control or regulating apparatus 17 and can transmit their measuring results thereto. These measurements form the basis for control or regulating algorithms and cause the generation and transmission of corresponding control commands in the control or regulating apparatus 17 to the continuous furnace 1 or the magnetron 4 arranged there.

Alternatively or in combination, further upstream apparatuses of the production facility or the control station of the system for transmitting data can be in operative connection with the control or regulating apparatus 17.

These measuring apparatuses 16, 18, 20 may preferably be suitable for measuring the width 19 of the material 3 or of the product 8 in sections.

As is further shown in FIG. 1, the material 3 is applied to the conveyor belt 10 in a height which is small compared to the width 19. Preferably, the material 3 is pressed in this width 19 in the subsequent press 2 to the product 8. The material 3 is thus preferably strand-shaped, in this case having an upper and a lower surface side, wherein one surface side rests on the conveyor belt 10 and forms two edges 7. The position of the edges 7 on the conveyor belt 10 is varied in accordance with experience, in particular by the belt course during the application of the material 3 onto the conveyor belt 10, by changes in trimming or product changeover. The subsequent course of the belt in the region of the continuous furnace 1 can also lead to consequence that the conveyor belt 10 is not always guided through the continuous furnace 1 in the same position.

FIG. 2 shows a top view in the production direction 15 from the bottom upwards on the cover 22 of the radiation chamber 14 in a section X2-X2 from FIG. 3. FIG. 3 shows the corresponding view of a section X3-X3 through the radiation chamber 14 according to FIG. 2, wherein the production direction 15 is directed into the drawing plane.

The following embodiment of the radiation chamber 14 is obtained from the combination of the two FIGS. 2 and 3. The magnetrons 4 are preferably arranged separately in a cabinet 13 and to the side of the radiation chamber 14 for better accessibility, in particular for maintenance or replacement purposes. The cabinet 13 has openings through which the hollow conductors 5 connected to the magnetrons 4 conduct the microwaves to the radiation chamber 14 and enter the radiation chamber 14 there via the outlet openings 6, corresponding to openings in the cover 22. In the top view it can be seen that the outlet openings 6 are arranged in a plurality of rows R ($R_n$, $R_{n+1}$) transversely to the production direction 15 and tracks S ($S_n$, $S_{n+1}$) longitudinally to the production direction 15.

The manner in which the outlet openings 6 are arranged on the radiation chamber 14 depends on the use of the continuous furnace 1, the frequency of the microwave radiation which has an influence on the size of the hollow conductors 5 and thus on the outlet openings 6, and in particular also on the type and the volume of the material to be heated 3. It can therefore be possible to use only a small number of magnetrons 4, wherein at least two thereof must be arranged. These then form a row in any direction. However, it is preferably provided that at least a plurality of magnetrons 4 is arranged in a row R and can be controlled by means of the control or regulating apparatus 17 with a differentiated power profile 9. Already one row R, possibly but not necessarily transversely but angularly (except parallel) to the production direction, enables the differentiated heating of the material 3 across the width 19.

In particular, with a corresponding arrangement and/or alignment of the outlet openings 6 of the hollow conductors 5, a differentiated heating profile in the material 3 or a differentiated power profile 9 of the magnetron 4 can be controlled. The possibilities for this are manifold.

According to FIG. 3, a second radiation chamber 14' can be provided, opposite the first radiation chamber 14 with respect to the material 3 and thus arranged below the conveyor belt 10. It can preferably have the same configuration concerning magnetrons/hollow conductors/outlet openings as the radiation chamber 14. The material 3 to be heated here has a predetermined width 19 and rests on the conveyor belt 10 passing through the continuous furnace 1. The material 3 is essentially of an strand-like configuration, has two surface sides and a respective edge 7.

Use of a single track S with in each case one outlet opening 6 per row R: It is possible to control the material 3 in the production direction 15 with differentiated powers L, e.g. a rising power scale ($R_1$=20%, $R_2$=40%, $R_3$=60%, $R_4$=80%, $R_5$=100% at at least 5 rows). This may be advantageous if the material 3 is present, for example in a supercooled or frozen manner and, if appropriate, has been impregnated with water. Alternatively, the power scale can also be used vice versa if first a strong heating and then a homogenisation of the heat in the material 3 with a lower microwave intensity is to be supported.

Use of a single row R with a respective outlet opening 6 per track S:

It is possible to control the material 3 transversely to the direction of production 15 with differentiated powers L, for example a heating which increases from the edge 7 of the material 3 to the longitudinal centre line 21 ($S_1$=25%, $S_2$=50%, $S_3$=75%, $S_4$=50%, $S_5$=25% at at least 5 tracks). As already mentioned above, the possibilities are manifold and not all of them are finally described.

Use of a plurality of rows $R_n$, $R_{n+1}$ with exit opening 6 and several tracks $S_n$, $S_{n+1}$ according to FIG. 2:

Very complex power profiles L can be set in and across the production direction. Thus, in a 3D view, a three-dimensional power profile is obtained by setting different powers in different magnetrons 4. In particular, for the optimised heating, the space-time component and the heating degree together with the throughput speed during heating or in the control or regulating apparatus 17 should also be taken into account.

In a simple exemplary embodiment according to FIG. 4 for a power profile 9, a material 3 of a width 19 is conveyed through the radiation chamber 14, as shown in FIG. 3. According to FIGS. 4 and 2, the number of tracks S is equal to 16. Due to the possibility of controlling all the magnetrons 4 individually or in groups, the magnetrons 4, which are in operative connection with the outlet openings 6 of the tracks $S_1$, $S_2$ on the left and $S_{15}$, $S_{16}$ on the right, are deactivated and have a power L=0%, since they are arranged directly above a region which is not occupied by the material 3. In order to ensure that the edge region of the material 3 is heated only slightly, the magnetrons 4 of the tracks $S_3$, $S_4$ on the left and $S_{13}$, $S_{14}$ on the right of the outlet openings 6, which are arranged on the edge 7 of the material 3, are operated with only half the necessary power L=40%. The regions of the material 3 lying further inward of the longitudinal centre line 21 are subjected to a power L=80% of the magnetrons and are heated accordingly. For this simple application, the subsequent rows can accordingly represent the same power profile 9, as shown in FIG. 4.

Advantageously, the use of a plurality of rows R and tracks S is possible in a method for protecting the magnetrons 4 by alternately switching the magnetrons 4 on and off. Switching on and off does not describe the power cycle, which is usually used to adjust the power L of a magnetron, but the pause of the magnetrons is provided to maintain the performance capabilities and to avoid overheating, i.e. a usage cycle.

In a simple, plausible example, the continuous furnace could be operated as follows:

When calculating the necessary power for heating the material to a predetermined temperature, the necessity arises, when all the available magnetrons 4 are used, to operate them at 35% of the rated power, wherein it is assumed for the sake of simplicity that all magnetrons 4 would operate with the same power L. It is now determined that with an arrangement of the outlet openings 6 as in FIG. 2, n=6 applies to $R_N$ and $S_n$. Thus, there are 36 exit openings 6 for six rows R and six tracks S. In order to protect the magnetrons 4, a running operation is now proposed in which the magnetrons 4 of all tracks S are used, but the rows R with even n and the rows R with odd n are alternately switched on. For this purpose, the rated power of the active 18 magnetrons 4 (36/2) is doubled so that they are operated with a nominal power of 70%. An unnecessary continuous operation of the magnetrons 4 is thus avoided.

LIST OF REFERENCE NUMERALS

1 Continuous furnace
2 Press
3 Material
4 Magnetron
5 Hollow conductor
6 Outlet opening
7 Edge
8 Product
9 Power profile
10 Conveyor belt
11 Housing
12 Absorber
13 Cabinet
14 Radiation chamber
15 Production direction
16 Measuring apparatus
17 Control or regulating apparatus
18 Measuring apparatus
19 Width
20 Measuring apparatus
21 Longitudinal centre line
22 Cover
R Row of outlet openings transversally to 15
S Track of the outlet openings in 15
L Power of 4

The invention claimed is:

1. A method for the continuous production of material boards made of essentially non-metallic material, comprising:

continuously heating material on an endlessly circulating conveyor belt via a continuous furnace;

providing a press downstream in a production direction;

generating electromagnetic waves via a plurality of magnetrons included in the continuous furnace;

feeding the electromagnetic waves into a radiation chamber via hollow conductors with outlet openings; and controlling individual magnetrons or the plurality of magnetrons to operate the magnetrons with different powers for a differentiated power profile in and/or transversely to the production direction.

2. The method according to claim 1, wherein the magnetrons are controlled by a control or regulating apparatus.

3. The method according to claim 2, wherein the control or regulating apparatus is configured for retrieving and setting predetermined power profiles based on the material, a construction of the material and/or a product to be produced.

4. The method according to claim 2, wherein the material and/or a product is checked by at least one measuring apparatus, and the corresponding measured values are transmitted to the control or regulating apparatus for controlling or regulating the magnetrons or the power profile.

5. The method according to claim 2, further comprising determining a speed of the conveyor belt via a drive of the conveyor belt or a measuring apparatus, and the determined speed is transmitted to the control and regulating apparatus and used to calibrate a power cycle and/or a utilization cycle of the magnetrons against a feed of the material.

6. The method according to claim 2, wherein the control or regulating apparatus is configured to automatically monitor or detect the magnetrons or their power consumption, and automatically activate necessary power or further magnetrons.

7. The method according to claim 2, wherein the control or regulating apparatus is configured to apply higher power to local surface weight increases in the material occurring transversely to the production direction via a path/time tracking, and to control the magnetrons for such a purpose in a corresponding temporal and geometric arrangement.

8. The method according to claim 1, wherein the magnetrons are operated at a power of 0.5 to 20 kW.

9. The method according to claim 1, further comprising deactivating a passive and/or active distributor in the radiation chamber for the electromagnetic waves during heating of the material with different powers of the magnetrons.

10. The method according to claim 1, wherein a power profile of the magnetrons is set transversely to the production direction, which sets a higher temperature of the material from edges to a longitudinal center line of the material.

11. The method according to claim 1, wherein the magnetrons are arranged in a plurality of rows and tracks, and in an event of failure of a magnetron, one or several other magnetrons of associated and/or adjacent tracks compensate for the failure by increasing their power, or, in a case of maximum power of the magnetrons, the failure is compensated for by switching off a whole row of magnetrons and reducing a speed of the conveyor belt correspondingly.

12. The method according to claim 1, wherein the magnetrons are arranged in a plurality of rows and tracks, and wherein at different widths of the material and/or varying positions of the material on the conveyor belt, at least one track of the magnetrons arranged on an edge is correspondingly switched off or reduced in power.

13. The method according to claim 1, wherein, in order to increase redundancy, additional magnetrons that are not used in regular operation are provided, the additional magnetrons being configured to switch on in the event of a magnetron failure.

14. A method for the continuous production of material boards made of essentially non-metallic material, comprising:

continuously heating material on an endlessly circulating conveyor belt via a continuous furnace;

providing a press downstream in a production direction;

generating electromagnetic waves via a plurality of magnetrons included in the continuous furnace;

feeding the electromagnetic waves into a radiation chamber via hollow conductors with outlet openings; and controlling individual magnetrons or the plurality of magnetrons to operate the magnetrons with different powers for a differentiated power profile in and/or transversely to the production direction, wherein a corresponding power profile of the magnetrons is activated transversely to the direction of production in a material with a different surface weight profile over a width, and wherein regions of different surface weights are subjected to different powers of the electromagnetic waves.

15. A method for the continuous production of material boards made of essentially non-metallic material, comprising:

continuously heating material on an endlessly circulating conveyor belt via a continuous furnace;

providing a press downstream in a production direction;

generating electromagnetic waves via a plurality of magnetrons included in the continuous furnace;

feeding the electromagnetic waves into a radiation chamber via hollow conductors with outlet openings; and controlling individual magnetrons or the plurality of magnetrons to operate the magnetrons with different powers for a differentiated power profile in and/or transversely to the production direction, wherein the material comprises wood or wood-like material with a different surface weight profile over a width thereof, and wherein the magnetrons with outlet openings essentially above areas of higher surface weight are operated with a higher power than the magnetrons with outlet openings above areas of lower surface weight.

* * * * *